US005829369A

United States Patent [19]

Sivy et al.

[11] Patent Number: 5,829,369

[45] Date of Patent: Nov. 3, 1998

[54] PULVERIZED COAL BURNER

[75] Inventors: Jennifer L. Sivy, Alliance; Larry W. Rodgers, Canton; John V. Koslosy, Akron; Albert D. LaRue, Uniontown; Keith C. Kaufman; Hamid Sarv, both of Canton, all of Ohio

[73] Assignee: The Babcock & Wilcox Company, New Orleans, La.

[21] Appl. No.: 747,319

[22] Filed: Nov. 12, 1996

[51] Int. Cl.[6] ..... F23C 1/10; F23C 1/12

[52] U.S. Cl. ..... 110/347; 110/104 B; 110/260; 110/261; 110/262; 110/263; 110/265; 431/8; 431/9; 431/10; 431/181; 431/182; 431/183; 431/184; 431/187

[58] Field of Search ..... 431/8, 9, 10, 115, 431/116, 181, 182, 183, 184, 187, 104 B; 110/260, 261, 262, 263, 264, 265, 347, 348

[56] References Cited

U.S. PATENT DOCUMENTS

| | | | |
|---|---|---|---|
| 1,661,031 | 2/1928 | Butcher . | |
| 4,303,386 | 12/1981 | Voorheis et al. | 431/177 |
| 4,422,391 | 12/1983 | Izuha et al. | 110/347 |
| 4,479,442 | 10/1984 | Itse et al. | 110/261 |
| 4,545,307 | 10/1985 | Morita et al. | 110/264 |
| 4,718,359 | 1/1988 | Skoog | 110/264 |
| 4,748,919 | 6/1988 | Campobenedetto et al. | 110/264 |
| 4,807,541 | 2/1989 | Masai et al. | 110/262 |
| 4,836,772 | 6/1989 | LaRue | 431/285 |
| 4,907,962 | 3/1990 | Azuhata et al. | 431/174 |
| 4,915,619 | 4/1990 | LaRue | 431/284 |
| 5,145,359 | 9/1992 | Ancona et al. | 431/184 |
| 5,199,355 | 4/1993 | LaRue | 110/261 |
| 5,431,114 | 7/1995 | Morita et al. | 110/265 |
| 5,470,224 | 11/1995 | Bortz | 431/182 |
| 5,526,758 | 6/1996 | Giammaruti et al. | 110/263 |
| 5,588,380 | 12/1996 | LaRose | 110/263 |
| 5,649,494 | 7/1997 | Hufton | 110/262 |
| 5,651,320 | 7/1997 | Leisse et al. | 110/262 |
| 5,680,823 | 10/1997 | LaRose | 110/262 |
| 5,685,242 | 11/1997 | Narato et al. | 110/262 |

FOREIGN PATENT DOCUMENTS

| | | | |
|---|---|---|---|
| 59-147920 | 8/1984 | Japan | 431/183 |

OTHER PUBLICATIONS

M. Jochem, et al. "Development of an Ultra Low $NO_x$ Staged Mixing Burner For Pulverized Coal", Int. Joint Power Generation Conf. Oct. 14–16, 1996.

J.L. Sivy et al., "Development of an Advanced Low $NO_x$ Burner In Support of BCW's Advanced Coal Fired Low–Emission Boiler System "1995 AFRC Fall International Symposium on Oct. 17, 1995 pp. 1–20.

*Primary Examiner*—Ira S. Lazarus
*Assistant Examiner*—Ljiljana V. Ciric
*Attorney, Agent, or Firm*—Daniel S. Kalka; Robert J. Edwards

[57] ABSTRACT

A burner having lower emissions and lower unburned fuel losses by implementing a transition zone in a low $NO_x$ burner. The improved burner includes a pulverized fuel transport nozzle surrounded by the transition zone which shields the central oxygen-lean fuel devolatilization zone from the swirling secondary combustion air. The transition zone acts as a buffer between the primary and the secondary air streams to improve the control of near-burner mixing and flame stability by providing limited recirculation regions between primary and secondary air streams. These limited recirculation regions transport evolved $NO_x$ back towards the oxygen-lean fuel pyrolysis zone for reduction to molecular nitrogen. Alternate embodiments include natural gas and fuel oil firing.

17 Claims, 8 Drawing Sheets

PULVERIZED COAL BURNER

This invention was made with government support under Contract No. DE-AC22-92PC92160 awarded by the Department of Energy. The government has certain rights in this invention.

BACKGROUND OF THE INVENTION

1. Field of the Invention

The present invention relates in general to fuel burners, and in particular to an improved pulverized coal fuel burner which limits nitrogen oxides ($NO_x$) generation.

2. Description of the Related Art

Oxides of nitrogen ($NO_x$) form in a flame such as a pulverized coal flame when nitrogen bearing compounds are released from the fuel during pyrolysis. These compounds combine with available oxygen to form NO and $NO_2$, for example as shown in FIG. 1. FIG. 1 depicts typical $NO_x$ reaction mechanisms. $NO_x$ can also be formed when high temperatures (greater than 2700° F.) are sustained in a flame region where nitrogen and oxygen are present. Under this condition, the molecular nitrogen dissociates and recombines with oxygen forming thermal $NO_x$.

It is known that lower $NO_x$ emissions can be obtained from pulverized coal flames by "staging" or delaying the mixing of some of the combustion air with a fuel so that the released nitrogen volatiles combine to form molecular nitrogen instead of $NO_x$. In the reducing atmosphere produced by staging, molecules of $NO_x$ that do form can also be more readily reduced back to molecular nitrogen. This process of staging may be completed externally to the burner by removing some of the combustion air from the burner and introducing it at another location in the furnace.

There exist aerodynamically air-staged burners commercially available that operate on the principle of internal staging where a low $NO_x$ flame is produced by controlling the combustion air at the burner itself rather than physically separating the locations of fuel and air addition. The internal staging is accomplished by aerodynamically distributing the combustion air across multiple air zones. The internal staging is enhanced by the addition of a swirl velocity to the combustion air and the use of various burner hardware configurations to redirect the combustion air streams. Burnout of the fuel is completed away from the primary combustion zone as the redirected combustion air mixes into the flame downstream.

The Babcock & Wilcox Company has developed, tested, and produced a series of pulverized coal burners which reduce $NO_x$ emissions through the use of multiple air zones. One example is shown in FIG. 2 and offered commercially under the registered name DRB-XCL® burner. This aerodynamically staged burner has been shown to be successful at significantly reducing $NO_x$ levels from standard high swirl burners which rapidly mix the fuel and air near the burner exit. However, the longer flames produced by this low-$NO_x$ burner design may exhibit lower combustion efficiency through increased carbon monoxide (CO) emissions and high levels of unburned carbon. In general, the measured levels of exit $NO_x$ and combustion efficiency have been shown through previous testing to be inversely related.

Referring to FIG. 2, there is shown a coal-fired DRB-XCL® burner similar to the burner described in U.S. Pat. No. 4,836,772 to LaRue. The burner (10) includes a conical diffuser (12) and deflector (34) situated within the central conduit of the burner (10) which is supplied with pulverized coal and air by way of a fuel and primary air (transport air) inlet (14). A windbox (16) is defined between the inner and outer walls (18), (20) respectively. The windbox (16) contains the burner conduit which is concentrically surrounded by walls which contain an outer array of fixed spin vanes (22) and adjustable angle spin vanes (24). An air separator plate (26), concentrically around the burner nozzle, helps channel secondary air supplied at (28). The burner (10) is provided with a flame stabilizer (30) and a slide damper (32) for controlling the amount of secondary air (28).

U.S. Pat. No. 4,380,202 to LaRue et al. is also relevant to a burner having a conical diffuser and some of the other elements in FIG. 2. Impellers are routinely installed on coal nozzles to reduce flame length at the expense of emissions. Impellers and similar devices, such as swirlers only change the fuel stream flow patterns. These approaches can enhance fuel and air mixing which increases $NO_x$ emissions.

U.S. Pat. No. 4,479,442 to Itse et al. discloses a venturi nozzle for pulverized coal including a divergent flow separator and multiple swirl vanes.

There still exists a need for an advanced low-$NO_x$ burner which obtains even lower $NO_x$ emissions yet as a minimum provides comparable unburned combustibles and carbon monoxide (CO) emissions. Preferably, such a burner would deliver a combined stream of pulverized coal and air with additional streams of combustion air alone to control the combustion characteristics of the pulverized coal flame. The burner design would provide a stable, strong flame with both low pollutant emissions and high combustion efficiency. This type of burner configuration is preferable to allow the burner to be installed in existing boilers or furnaces.

SUMMARY OF THE INVENTION

The present invention is directed to solving the aforementioned problems with the prior art burners as well as others by providing a burner which can achieve low $NO_x$ emissions yet maintain high combustion efficiency. As used herein, high combustion efficiency refers to the minimization of the levels of unburned carbon and carbon monoxide leaving the furnace. The present invention surpasses previous $NO_x$ reduction limits by effectively combining aerodynamic distribution of the combustion air to limit $NO_x$ generation with unique burner features that provide a stable flame and acceptable combustion efficiency. These features interact to produce an efficient low $NO_x$ burner as described herein. The present invention separates the primary and secondary streams near the burner while employing a range of secondary air velocities, to promote higher turbulence levels and improve downstream mixing. Air distribution cones in combination with the transition zone permit redirection of secondary air without dissipating swirl imparted to the secondary air by the vanes. This further improves flame stability and downstream mixing. Secondary air is separated physically and aerodynamically from the core fuel zone near the burner by the transition zone, thereby preventing direct fuel entrainment. The use of secondary swirl and air distribution cones locally redirects the air away from the flame core while still permitting mixing downstream.

Accordingly, one object of the present invention is to provide an advanced low $NO_x$ burner which diverts combustion air away from the primary combustion region near the burner exit reducing the local stoichiometry during coal devolatilization, and thus reducing initial $NO_x$ formation.

Another object of the present invention is to provide an advanced low $NO_x$ burner which provides a stable flame with both low pollutant emissions and high combustion efficiency.

Still a further object of the present invention is to provide a burner which is simple in design, rugged in construction and economical to manufacture.

The various features of novelty which characterize the present invention are pointed out with particularity in the claims annexed to and forming a part of this disclosure. For a better understanding of the invention, its operating advantages and specific objects attained by its uses, reference is made to the accompanying drawings and descriptive matter in which the preferred embodiment of the invention is illustrated.

DESCRIPTION OF THE PREFERRED EMBODIMENTS

Figure 1:
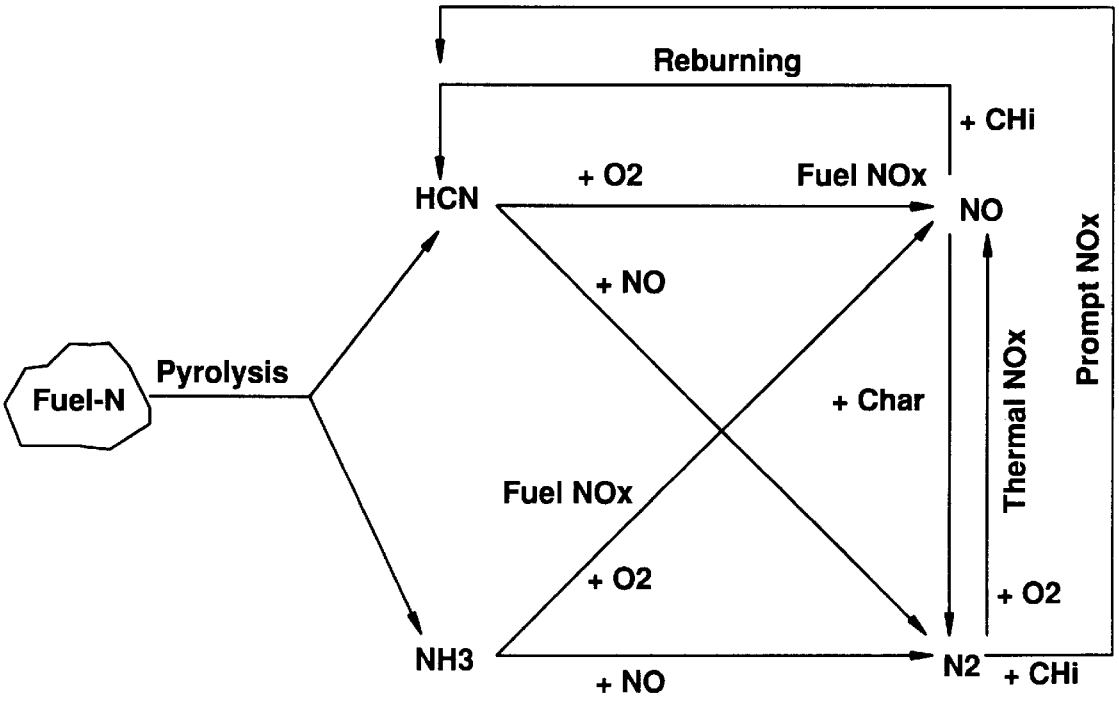
FIG. 1 is a graph illustrating $NO_x$ reaction mechanisms.
Figure 2:
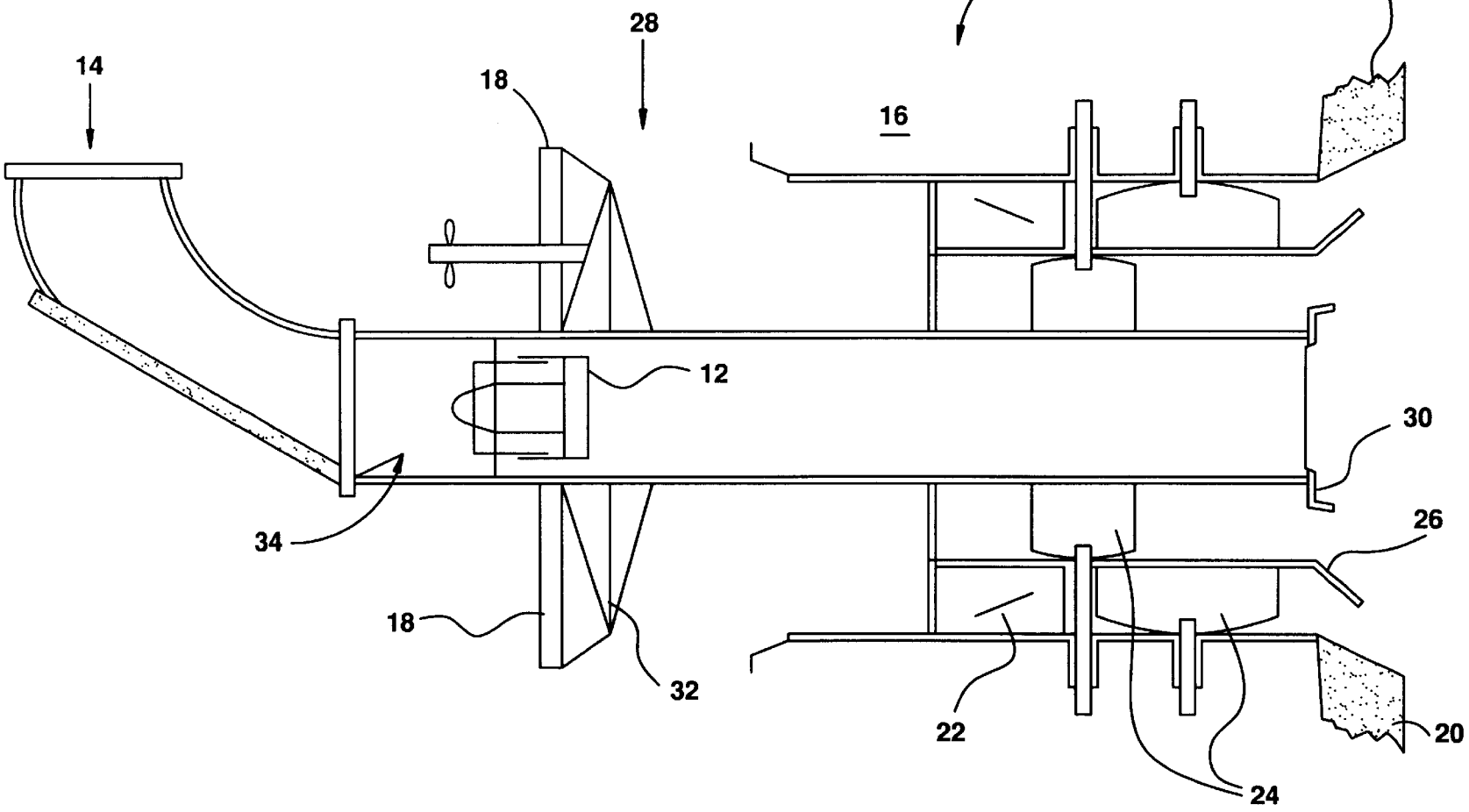
FIG.2 PRIOR ART
FIG. 2 is a schematic sectional view of a known DRB-XCL® burner which is improved by the present invention.
Figure 3:
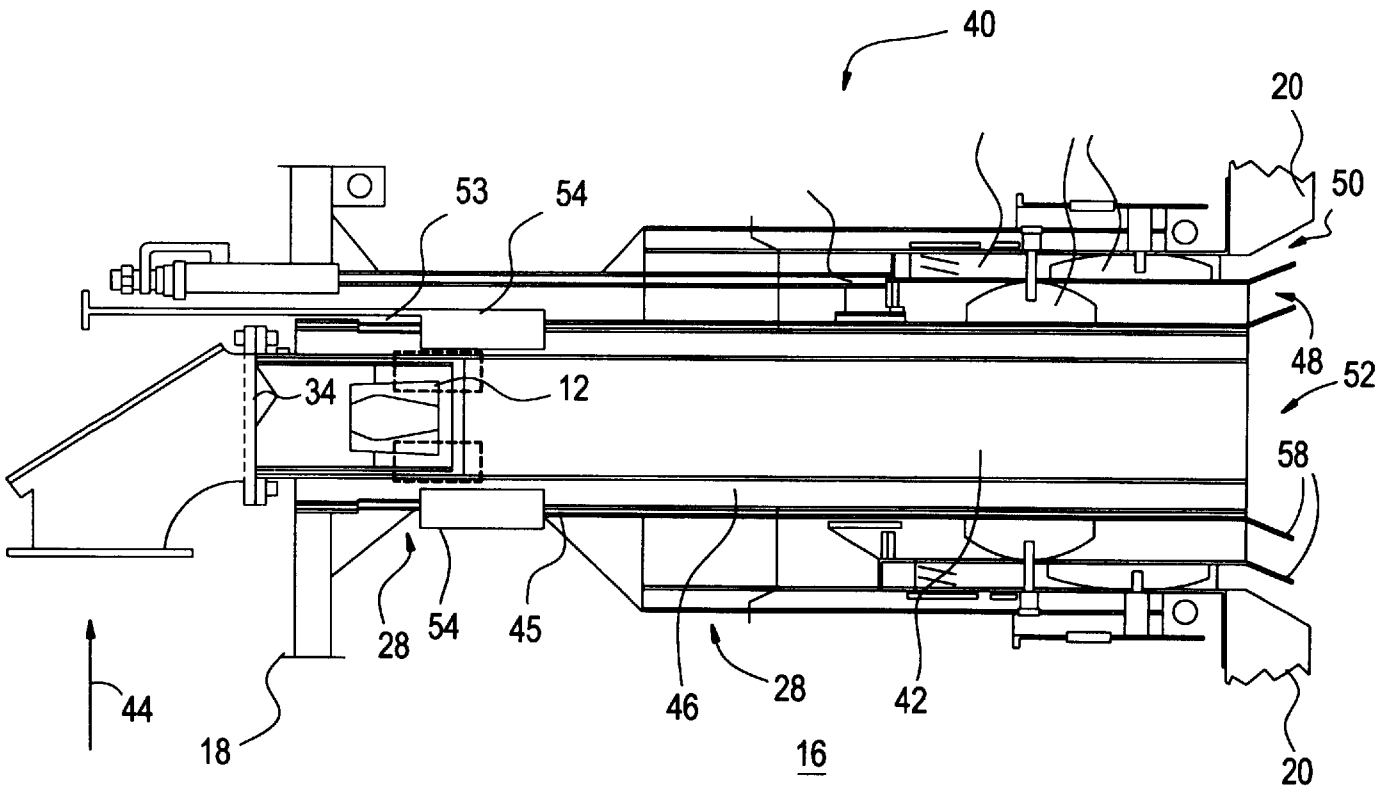
FIG. 3 is a schematic sectional view of the present invention.

Referring to the drawings where like numerals designate like or similar features throughout the several views and first to FIG. 3, there is shown a schematic sectional view of the burner generally depicted (40) in accordance with the present invention. Burner (40) which is also referred to as the DRB-4Z™ burner comprises a series of zones created by concentrically surrounding walls in the burner conduit which deliver a fuel such as pulverized coal with a limited stream of transport air (primary air), and additional combustion air (secondary air) (28) provided from the burner windbox (16). The central zone (42) of the burner (40) is a circular cross-section primary zone, or fuel nozzle, that delivers the primary air and pulverized coal by way of inlet (44) from a supply (not shown). Surrounding the central or primary zone (42) is an annular concentric wall (45) that forms the primary-secondary transition zone (46) which is constructed either to introduce secondary combustion air or to divert secondary air to the remaining outer air zones. The transition zone (46) acts as a buffer between the primary and secondary streams to provide improved control of near-burner mixing and flame stability. The transition zone (46) is configured to introduce air with or without swirl, or to enhance turbulence levels to improve combustion control. The remaining annular zones of burner (40) consist of the inner secondary air zone (48) and the outer secondary air zone (50) formed by concentrically surrounding walls which deliver the majority of the combustion air. Structurally, the design of the burner (40) according to the present invention is based largely on that for the DRB-XCL® burner shown in FIG. 2. However, the burner design according to the present invention includes annular concentric means (46) surrounding the central conduit (42) of the burner which supplies the pulverized coal and primary air. Furthermore, the burner design (40) has been modified to provide secondary air at a velocity somewhat higher than that for the DRB-XCL® burner. The burner velocity is selected to provide desired near-and far-field mixing characteristics without introducing high pressure drop and undesirable sensitivity in burner control. The burner (40) is designed to provide secondary air over a range of velocities dependent on the fuel and burner application. The range of velocities is selected to allow for the generation of sufficient radial and tangential momentum to create a radial separation between the primary and inner secondary streams. The burner (40) is preferably designed to deliver secondary air at velocities approximately equal to 1.0 to 1.5 times the primary air/fuel stream velocity.

In one embodiment tested, the nominal velocity of secondary air was about 5500 feet per minute (fpm), but commercial application may range from about 4500 to 7500 fpm.

The annular concentric transition means (46) is formed to have an area ranging from 0.5 to 1.5 times the area of the fuel nozzle (42) which is considered here to have a characteristic diameter of unity depending upon fuel type and quantity.

In one embodiment tested, the DRB-4Z™ burner had a transition zone area which was nominally equal in area to the fuel nozzle. However, it is envisioned that variations in this relationship in commercial burners can occur depending on design specifics such as primary air flow rate, primary and secondary air temperatures, and burner firing rates.

An important feature of the transition zone of this invention is that it provides improved control of secondary air mixing with the fuel in the root of the flame. This feature allows a fraction of the combustion air to be introduced to the flame from this annulus.

The burner (40) provides improved flexibility in the distribution of secondary air at the burner throat (52). Slotted openings (53) on the upper surface of the concentric wall defining the transition zone allow secondary air to enter into this region. The percentage of secondary air flow to the transition zone is controlled by a sliding sleeve (54) around the outside of the transition zone at the rear of the burner (40). For situations where secondary air is directed through the transition zone (46), turning vane assemblies (not shown) may be positioned within the transition zone (46) to introduce swirl. Another favorable air pattern at the exit of the transition zone may be accomplished using segmented blanking plates (not shown) which create interspersed regions of high and low mixing in the primary-secondary transition region. Additional air control devices may be readily introduced in the transition zone to further regulate the distribution and mixing of combustion air.

In a similar fashion to that of the DRB-XCL® burner, swirl is imparted to the secondary air passing through the inner (48) and outer (50) secondary air zones. Swirl is produced using a set of movable vanes (24) in the inner air zone (48) , and both fixed (22) and movable (24) vanes in the outer air zone (50). This configuration of vanes provides full control of the swirl and the distribution of combustion air around the burner (40) for the desired mixing characteristics. The movable vanes (24) in each zone, (48), (50), may be positioned in the fully closed (0° with respect to an axis that is substantially normal to the sectional view) or fully opened position (90°), or at any intermediate angle to optimize combustion performance. In the fully opened position, there is no swirl imparted by the movable vanes. The use of the secondary air zones in combination with the transition zone also eliminates the need for attached flame stabilization devices on the fuel nozzle outlet which interfere with the distribution of secondary swirl.

The distribution of air in the inner and outer secondary zones (48), (50) may be controlled using the movable vanes in each zone. In addition, the split or distribution of the secondary combustion air is also adjustable with different embodiments of a sliding disk (56) shown in FIG. 3. Sliding disk (56) is constructed to block the flow of air to the inner secondary zone (48), and can be automatically or manually adjusted to change the split of air between the inner and outer secondary air zones. Alternatively, sliding disk (56) can be enlarged to enable regulation of air to the inner and outer secondary air zones (48), (50), and the enlarged sliding disk is either manually or automatically controllable to balance air flow among burners in a multiple burner arrangement. Combinations of settings for the sliding disk (56) and the inner and outer vanes (22), (24) are used to provide a wide range of control in both air split and swirl at the burner exit (52).

Air distribution cones (58) may be added to the end of the concentric walls forming the fuel nozzle, the concentric wall forming the outer diameter of the transition zone, or the sleeve separating the inner and outer secondary air zones, or a combination of these locations. This option provides further control of the air direction and distribution leaving the burner throat (52). The cones (58) act to provide further control in tuning of the combustion air distribution as it exits the burner throat (52). Additional hardware modifications are readily incorporated into the burner (40) configuration described herein and provide additional performance control as necessary.

Figure 4:
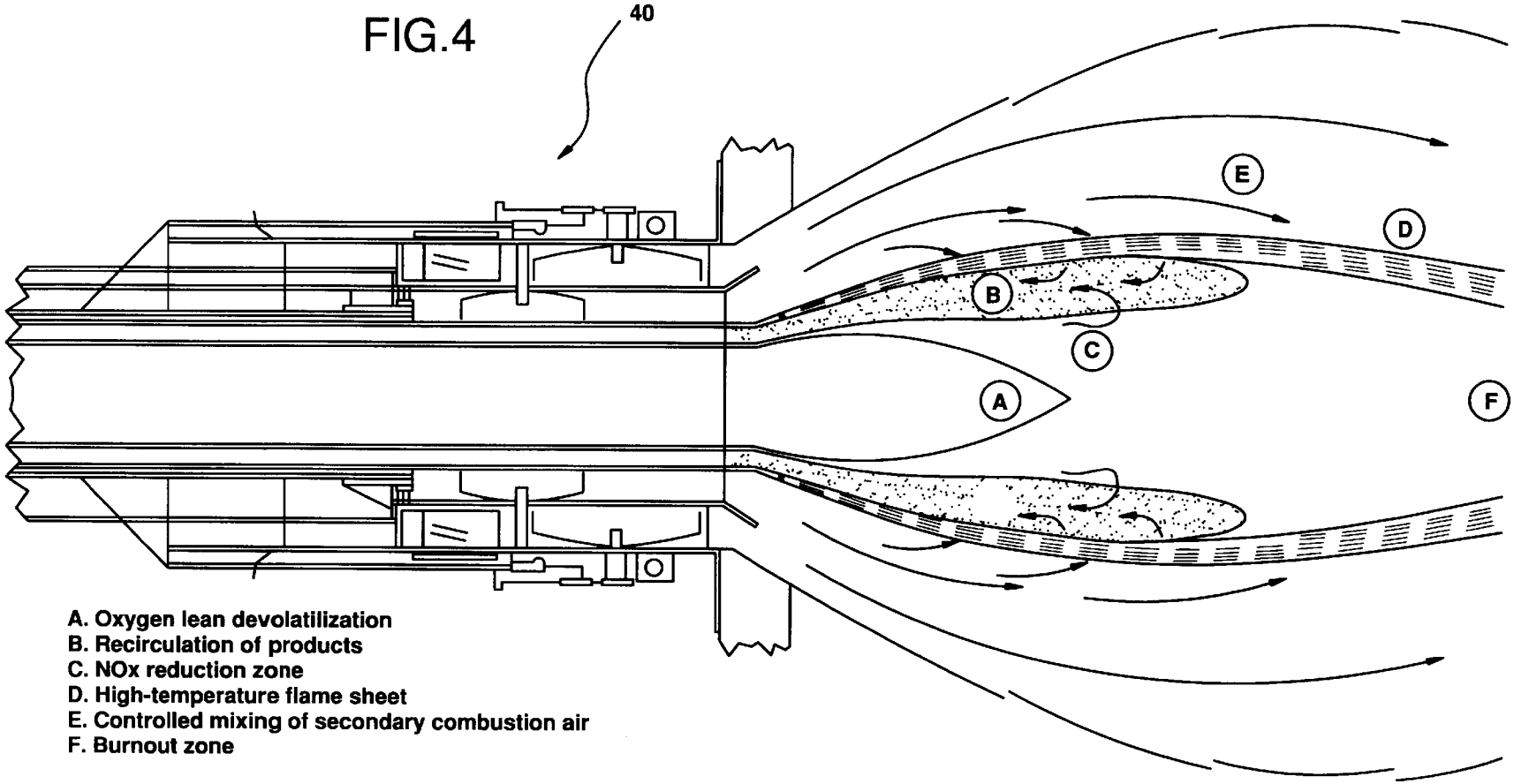
FIG. 4 is a schematic sectional view of a burner according to the present invention showing the burner flame characteristics.

Next, referring to FIG. 4, the burner design (40) according to the present invention produces a low-$NO_x$ pulverized coal flame by effectively diverting most of the combustion air away from the primary combustion region near the flame to control the local stoichiometry during coal devolatilization and thus reduce initial $NO_x$ formation. In FIG. 4, A is the oxygen lean devolatilization zone of the flame. Zone B is the zone where there is recirculation of products. C is a $NO_x$ reduction zone. D represents the high temperature flame sheet. E is the zone where there is controlled mixing of the secondary combustion air. F is the burnout zone. The limited recirculation regions between the primary and secondary streams act to transport evolved $NO_x$ back towards the oxygen-lean pyrolysis zone A for reduction to molecular nitrogen. The recirculation zones B also act to provide improved near burner flame stability and local mixing, thus improving overall combustion efficiency. The flame characteristics shown in FIG. 4 illustrate the overall advantages of the design according to the present invention in its improved emissions and combustion performance over existing low-$NO_x$ burner designs.

The individual advantages of the design according to the present invention can be grouped into several key areas. The first area is the improved $NO_x$ emissions performance. The burner (40) in accordance with the present invention is designed with several new aerodynamic features including the ability to operate at equivalent or increased secondary air velocities to the DRB-XCL® burner. The primary-secondary transition zone, and redesigned air distribution hardware are key to limited $NO_x$ formation and enhancing $NO_x$ distribution near the burner. These burner features promote separation of the primary and secondary streams near the burner, resulting in volatile release from the fuel in an oxygen-lean environment that limits $NO_x$ production. Since minimum levels of oxidant are required in this region to maintain ignition stability, $NO_x$ formation cannot be eliminated in this region. However, the burner aerodynamics also create local areas of recirculation B between the primary and secondary streams which act to return $NO_x$ back to the oxygen-lean region near the flame core for reduction.

In tests completed with the burner at both the 5 million Btu per hour (MBtu/hr) and the 100 MBtu/hr scale, the burner was shown to reduce $NO_x$ emissions by 15% to 50% on a weight percent basis over the optimum baseline values obtained for the DRB-XCL® burner for three different high volatile eastern bituminous coals that were tested. The $NO_x$ emissions achieved with the DRB-4Z™ burner while firing these coals, were less sensitive to fuel property variations than with the DRB-XCL® burner. Previous testing at combustion test facilities have demonstrated a strong inverse link between $NO_x$ emissions and combustion efficiency. Highest combustion efficiencies are produced by rapid, thorough mixing of the combustion air and fuel, resulting in short, high temperature flames. Low $NO_x$ burners decrease $NO_x$ emissions by creating longer, lower temperature flames that also yield lower combustion efficiencies because of delayed mixing.

Figure 5:
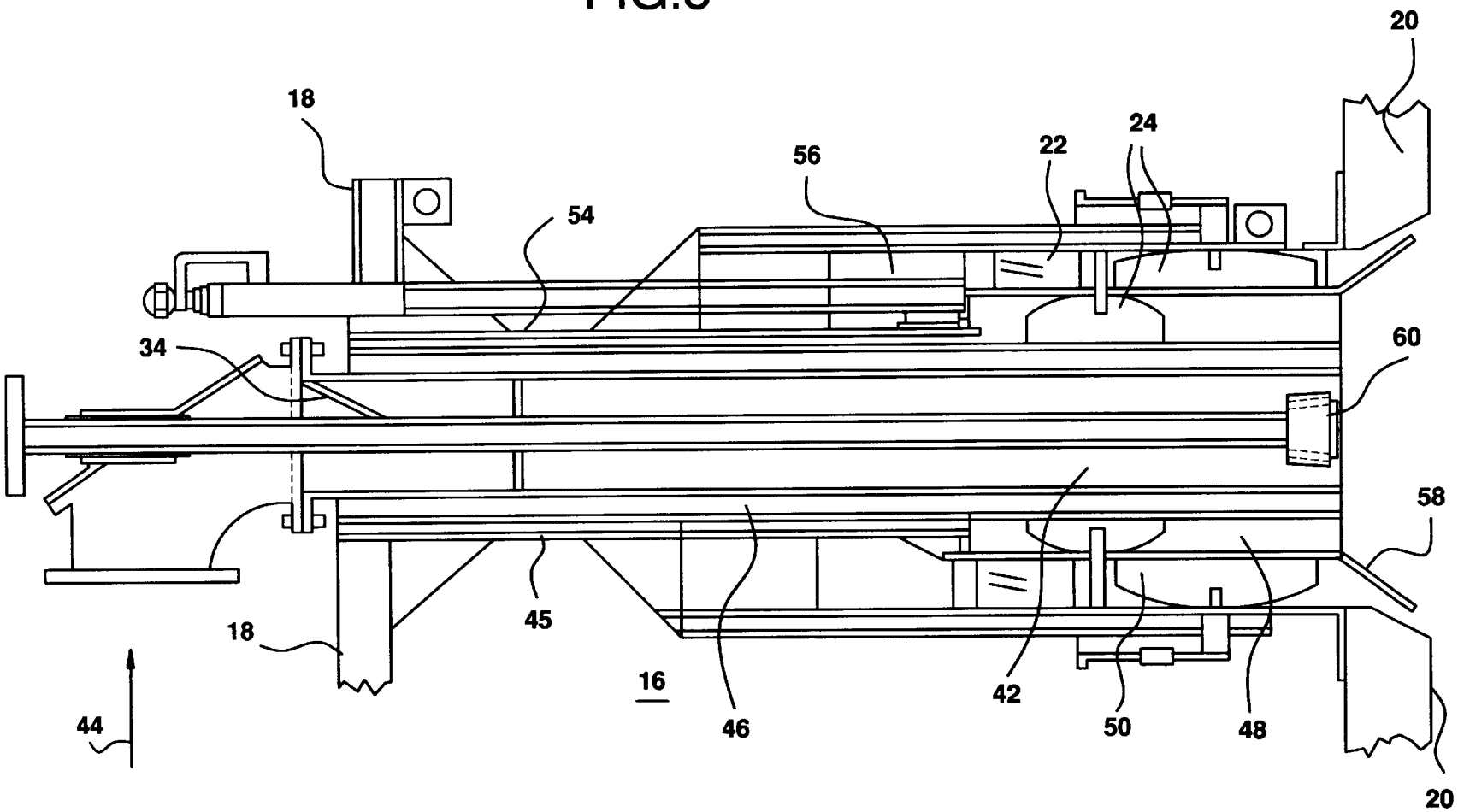
FIG. 5 is a schematic sectional view of an alternate embodiment according to the present invention.
Figure 6:
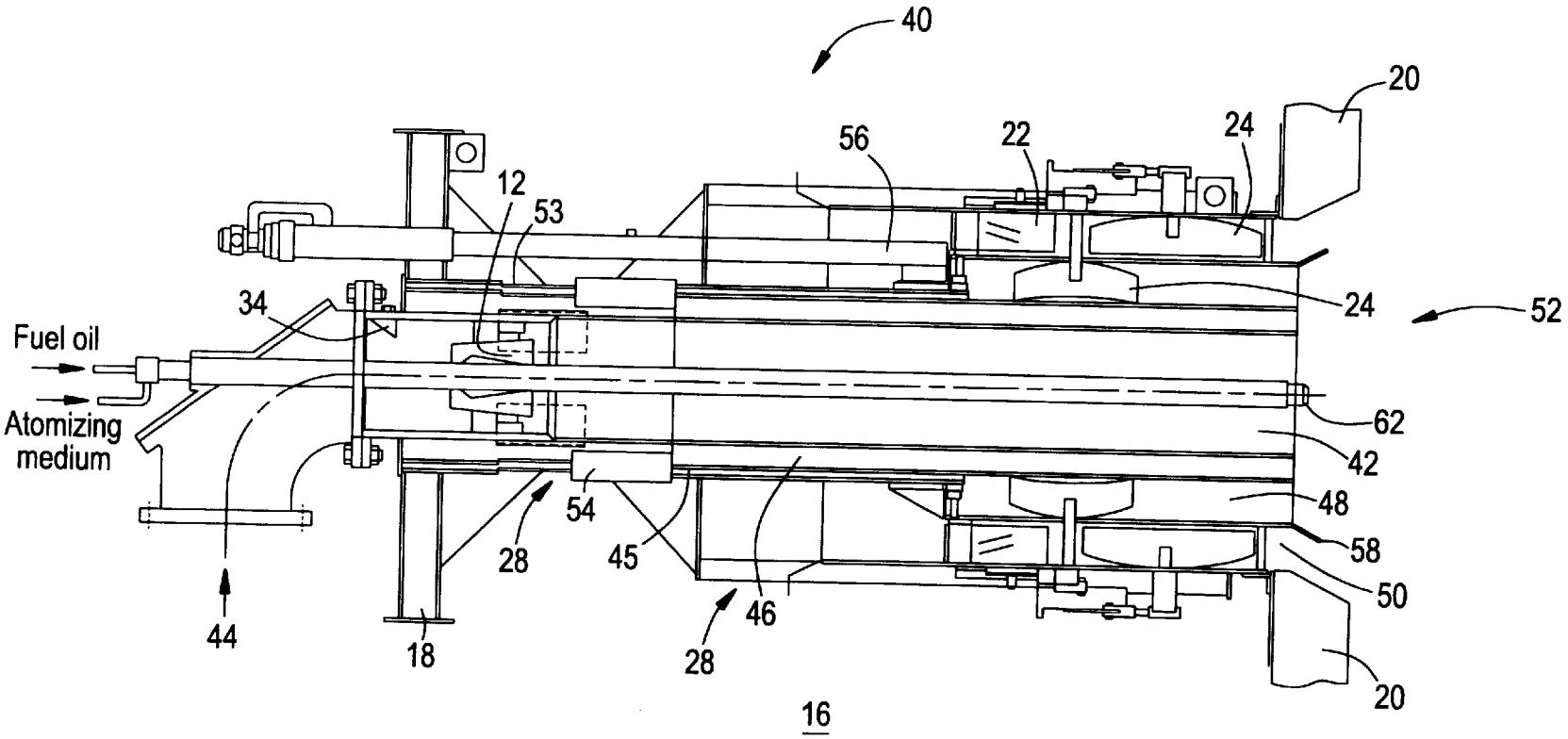
FIG. 6 is a schematic sectional view of an alternate embodiment according to the present invention.
Figure 7:
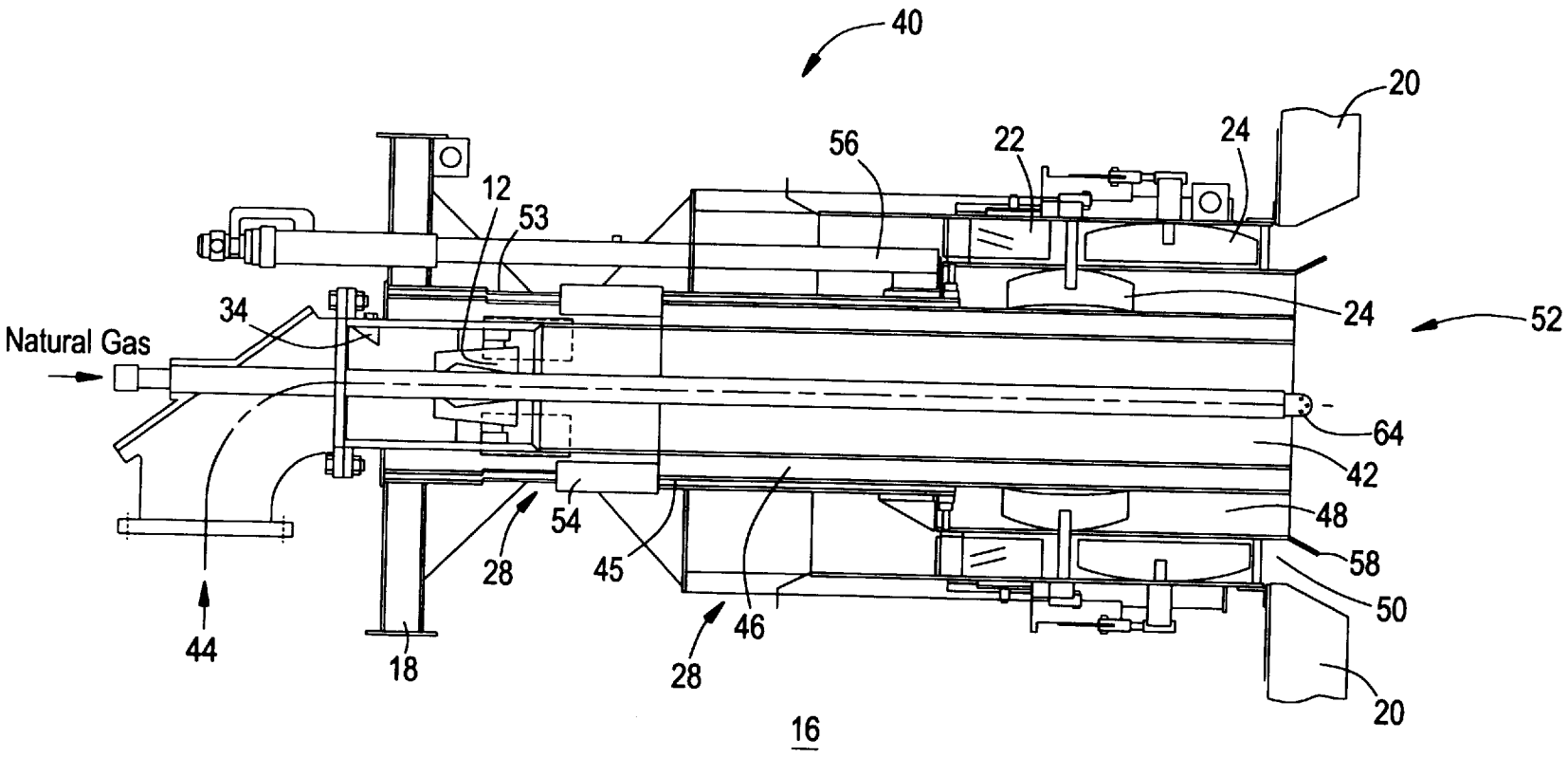
FIG. 7 is a schematic sectional view of an alternate embodiment according to the present invention.
Figure 8:
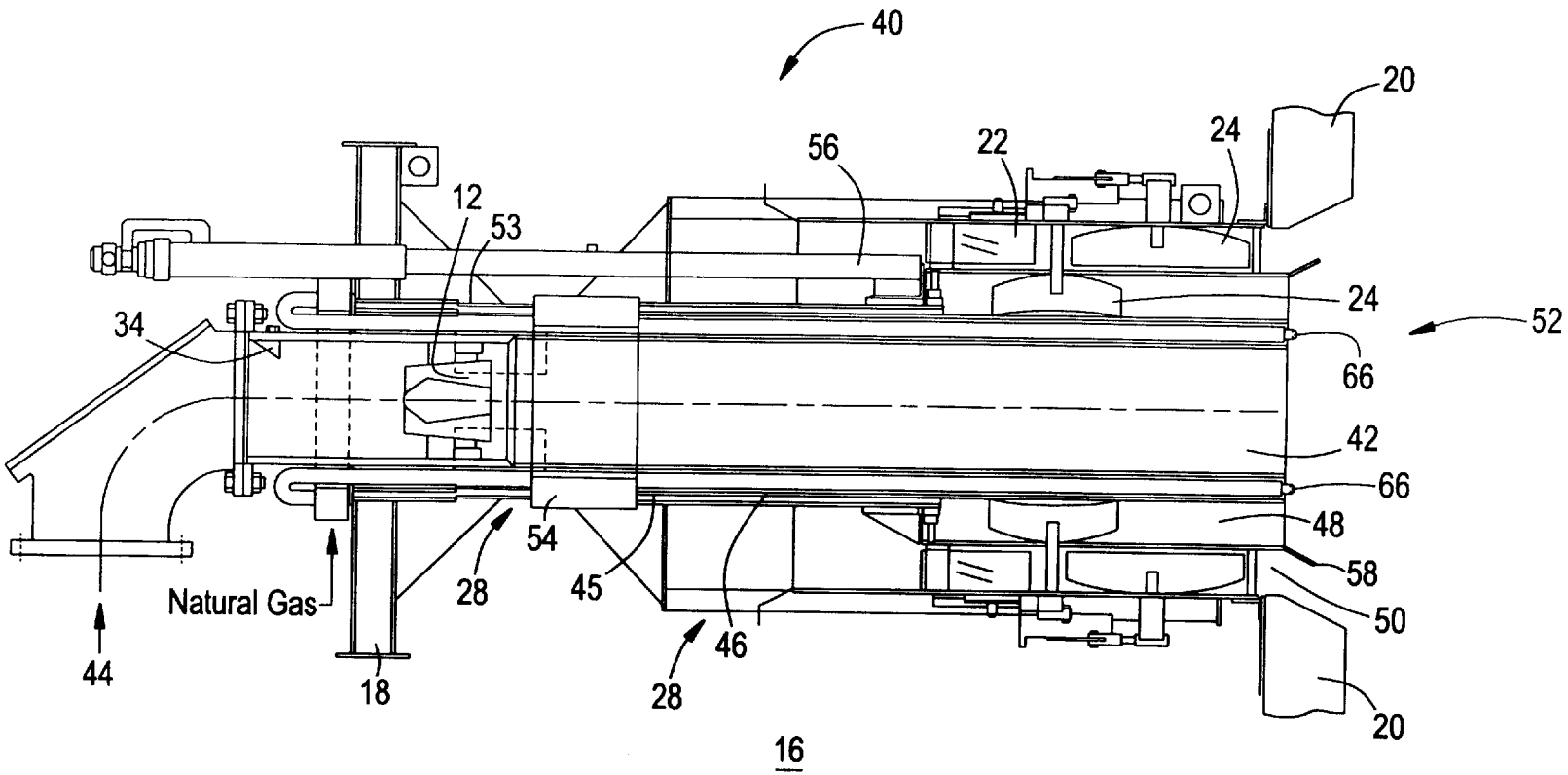
FIG. 8 is a schematic sectional view of an alternate embodiment according to the present invention.

The present invention addresses this difficulty by using higher secondary air velocities, while separating the primary and secondary streams near the burner. The increased secondary air velocities promote higher turbulence levels and swirl which improved downstream mixing. The secondary air is separated physically and aerodynamically from the core fuel zone A near the burner. The transition zone (46) physically separates the air streams, preventing direct entrainment, while the use of secondary swirl and air distribution cones locally redirects the air away from the flame core while still permitting mixing downstream. Recent tests have shown that the burner (40) offers lower $NO_x$ emissions without sacrificing combustion efficiency. In tests with three eastern bituminous coals, the burner according to the present invention showed effectively equivalent exit levels of carbon monoxide for two of the coals and lower loss-on ignition (LOI) at optimized settings for one of the coals, while simultaneously reducing $NO_x$ emissions compared to the DRB-XCL® burner. Loss-on ignition is a measure of combustion inefficiency. When necessary, coal nozzle mixing devices may be readily incorporated into the burner design to further improve combustion performance. One example of such a mixing device is an impeller (60) positioned within the primary zone (42) as shown in FIG. 5.

The design of the burner in accordance with the present invention incorporates a series of features that provide improved control over existing burners. The transition zone (46) provides a well-defined flame attachment region which does not interfere with the inner secondary air distribution or swirl. Transition zone (46) may also be configured to introduce a limited amount of secondary air effectively modifying the local primary air-to-coal ratio (PA/PC) This is used to mitigate burner temperature, direct additional air at the base of the flame and to further regulate near burner mixing. The air introduced through the transition zone (46) is controllable with one or a series of hardware components to swirl, radially direct, or add turbulence to the air. The air distribution through the secondary zones (48), (50) of the burner (40) are controllable either by the movable vanes (24) or the sliding disk (56), or both. The burner (40) of the present invention offers stability through the use of a combination of mechanical and aerodynamic stabilization concepts to produce the stable pulverized coal flame. The primary-secondary transition zone (46) acts as a flame anchoring region which provides improved flame attachment. The transition zone in combination with the secondary air stream produces a low momentum recirculation region between the primary and secondary streams which also promotes a stable flame. The secondary air design provides swirling combustion air to aerodynamically stabilize the flame and control flame mixing. These features, in conjunction with the range of control provided by the design as herein described, provide the ability to ensure flame stability over a wide range of load and firing conditions. Finally, the burner according to the present invention offers simplicity in that this design does not require the use of attached flame stabilization hardware which may be susceptible to high thermal cycling and corrosion. The burner design of the present invention is intended for use in both new and existing boilers. The burner may also be configured to fire a combination of fossil fuels, using minor changes to the existing hardware. For example, pulverized coal may be delivered through the primary zone, while a small amount of natural gas is injected through the transition zone. In this configuration, the natural gas would constitute between 5%–15% of the burner thermal input. Additionally, the DRB-4Z™ burner of the present invention does not require modifications on the primary air/fuel side and does not require high coal fineness.

While particular description has been made to pulverized coal, it is also well suited for firing fuel oil or natural gas. An oil atomizer 62 located in the central conduit (42) can enable oil firing in the preferential manner described herein. Alternately, one large spud (64) located in central conduit (42), or multiple smaller spuds (66) in transition zone (46) can enable gas firing in the preferential manner described herein.

While specific embodiments of the invention have been shown and described in detail to illustrate the application of the principles of the invention, it will be understood that the invention may be embodied otherwise without departing from such principles.

We claim:

1. A burner with low emissions and low unburned fuel losses, comprising:

means for defining a fuel nozzle for passage of a primary fuel with primary air for combustion in a primary zone, the fuel nozzle having an axis and further having an outlet end;

means for defining an annular transition zone concentrically surrounding said fuel nozzle defining means, said transition zone defining means being constructed to provide air for near-burner mixing and flame stability;

means for defining an inner secondary air zone and an outer secondary air zone, said inner secondary air zone having a wall concentrically surrounding said transition zone defining means, said outer secondary air zone having a wall concentrically surrounding said inner secondary air zone defining means, first means for imparting swirl positioned in said inner secondary air zone, second means for imparting swirl positioned in said outer secondary air zone, said inner and outer secondary air zones each having an outlet end; and means for diverting outer secondary air flow away from said fuel nozzle axis, said diverting means being attached to the wall concentrically surrounding said inner secondary air zone.

2. A burner as recited in claim 1, further comprising means for swirling air introduced through said transition zone for enhancing turbulence levels to improve combustion control.

3. A burner as recited in claim 1, wherein said first means for imparting swirl comprises first adjustable means for imparting swirl, said first adjustable means being positioned in said inner secondary air zone.

4. A burner as recited in claim 3, wherein said second means for imparting swirl comprises second adjustable means for imparting swirl, said second adjustable means being positioned in said outer secondary air zone.

5. A burner as recited in claim 1, further comprising air distribution means for controlling air direction attached to an outlet end of said transition zone defining means.

6. A burner as recited in claim 1, further comprising means for adjusting secondary combustion air, said adjusting means being at an inlet of said inner and outer secondary air zones for controlling flow of air thereto.

7. A burner as recited in claim 1, wherein said transition zone defining means includes a sliding sleeve surrounding slotted openings on an upper surface of a concentric wall defining said transition zone for controlling secondary air flow therethrough.

8. A burner as recited in claim 1, further comprising a coal mixing device positioned within said fuel nozzle for enhancing mixing during combustion.

9. A burner as recited in claim 1, further comprising at least one flow turning vane in said transition zone.

10. A burner as recited in claim 1, further comprising an atomizer in the fuel nozzle to enable oil firing.

11. A burner as recited in claim 1, further comprising a spud in the fuel nozzle to enable natural gas firing.

12. A burner as recited in claim 1, further comprising at least two spuds in the transition zone to enable natural gas firing.

13. A burner as recited in claim 1, wherein said second means for imparting swirl comprises fixed means for imparting swirl, said fixed means being positioned in said outer secondary air zone.

14. A method of reducing emissions and reducing unburned fuel losses in a pulverized coal burner having a pulverized coal and primary air nozzle with an outlet end and inner and outer secondary air zones concentrically located around the pulverized coal and primary air nozzle, the method comprising the steps of:

providing an annular concentric cylinder surrounding and spaced apart from the pulverized coal and primary air nozzle and positioned between the nozzle and the inner secondary air zone to form a transition zone surrounding a primary zone formed by the nozzle;

producing a pulverized coal flame by diverting secondary combustion air away from an oxygen lean devolatilization zone of a primary combustion region near the nozzle outlet;

producing a stoichiometry during coal devolatilization for reducing initial nitrogen oxides formation; and providing limited recirculation regions between primary and secondary air streams for transporting evolved nitrogen oxides back towards the oxygen-lean devolatilization zone for reduction to molecular nitrogen.

15. A method as recited in claim 14, further comprising the step of swirling air passing through an inner and an outer secondary air zone.

16. A method as recited in claim 15, further comprising the step of providing mixing to improve combustion efficiency with fixed and adjustable angle spin vanes positioned within the burner.

17. A burner with low emissions and low unburned fuel losses, comprising:

means for defining a fuel nozzle for passage of a primary fuel with primary air for combustion in a primary zone, the fuel nozzle having an axis and further having an outlet end;

means for defining an annular transition zone concentrically surrounding said fuel nozzle defining means, said transition zone defining means being constructed to provide air for near-burner mixing and flame stability; and means for defining an inner secondary air zone and an outer secondary air zone, said inner secondary air zone having a wall concentrically surrounding said transition zone defining means, said outer secondary air zone having a wall concentrically surrounding said inner secondary air zone, said inner and outer secondary air zones having an outlet end, and at least one flow turning vane near the outlet end, said inner and outer secondary air zones further including outwardly extending cones at the outlet end of said inner and outer secondary air zones and at an outlet end of said transition zone defining means.

* * * * *